US006189722B1

(12) United States Patent
Ason

(10) Patent No.: US 6,189,722 B1
(45) Date of Patent: Feb. 20, 2001

(54) COMPARTMENTALIZED COOKWARE SYSTEM

(76) Inventor: Ason, P.O. Box 516146, Dallas, TX (US) 75251-6146

( * ) Notice: Under 35 U.S.C. 154(b), the term of this patent shall be extended for 0 days.

(21) Appl. No.: 09/335,161

(22) Filed: Jun. 17, 1999

(51) Int. Cl.[7] ..... B65D 25/00
(52) U.S. Cl. ..... 220/573.1; 220/526; 220/553
(58) Field of Search ..... 220/573.1, 573.2, 220/526, 553, 556

(56) References Cited

U.S. PATENT DOCUMENTS 471,517 * 3/1892 Barry et al. ..... 220/526
867,086 * 9/1907 Sullivan ..... 220/553 X
950,844 * 3/1910 Dolan ..... 220/526 X
1,522,329 * 1/1925 Salucci ..... 220/553 X
2,123,359 * 7/1938 Hallmark ..... 220/553 X
2,695,238 * 11/1954 Ferguson ..... 220/526 X
3,007,595 * 11/1961 Remley ..... 220/526 X
3,845,875 * 11/1974 Douglas et al. ..... 220/556
3,983,275 * 9/1976 Winter et al. ..... 220/573.1 X
5,897,020 * 4/1999 Liu ..... 220/573.1 X

* cited by examiner

*Primary Examiner*—Steven Pollard

(57) ABSTRACT

A compartmentalized cookware system for cooking a plurality of different food items in a single container. The compartmentalized cookware system includes at least one cooking containers having a bottom wall, a perimeter side wall upwardly extending around the bottom wall, and an upper edge defining an open top into the respective cooking container. The cooking container has at least one dividing wall therein upwardly extending from the bottom wall of the respective cooking container and dividing the cooking container into a plurality of cooking compartments.

20 Claims, 3 Drawing Sheets

COMPARTMENTALIZED COOKWARE SYSTEM

BACKGROUND OF THE INVENTION

1. Field of the Invention

The present invention relates to compartmentalized cookware systems and more particularly pertains to a new compartmentalized cookware system for cooking a plurality of different food items in a single container.

2. Description of the Prior Art

The use of compartmentalized cookware systems is known in the prior art. More specifically, compartmentalized cookware systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,745,592; U.S. Pat. No. 4,817,512; U.S. Pat. No. 2,223,432; U.S. Pat. No. 4,198,040; U.S. Pat. No. 4,674,644; and U.S. Pat. No. Des. 263,670.

While these devices fulfill their respective, particular objectives and requirements, the aforementioned patents do not disclose a new compartmentalized cookware system. The inventive device includes at least one cooking containers having a bottom wall, a perimeter side wall upwardly extending around the bottom wall, and an upper edge defining an open top into the respective cooking container. The cooking container has at least one dividing wall therein upwardly extending from the bottom wall of the respective cooking container and dividing the cooking container into a plurality of cooking compartments.

In these respects, the compartmentalized cookware system according to the present invention substantially departs from the conventional concepts and designs of the prior art, and in so doing provides an apparatus primarily developed for the purpose of cooking a plurality of different food items in a single container.

SUMMARY OF THE INVENTION

In view of the foregoing disadvantages inherent in the known types of compartmentalized cookware systems now present in the prior art, the present invention provides a new compartmentalized cookware system construction wherein the same can be utilized for cooking a plurality of different food items in a single container.

The general purpose of the present invention, which will be described subsequently in greater detail, is to provide a new compartmentalized cookware system apparatus and method which has many of the advantages of the compartmentalized cookware systems mentioned heretofore and many novel features that result in a new compartmentalized cookware system which is not anticipated, rendered obvious, suggested, or even implied by any of the prior art compartmentalized cookware systems, either alone or in any combination thereof.

To attain this, the present invention generally comprises at least one cooking containers having a bottom wall, a perimeter side wall upwardly extending around the bottom wall, and an upper edge defining an open top into the respective cooking container. The cooking container has at least one dividing wall therein upwardly extending from the bottom wall of the respective cooking container and dividing the cooking container into a plurality of cooking compartments.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new compartmentalized cookware system apparatus and method which has many of the advantages of the compartmentalized cookware systems mentioned heretofore and many novel features that result in a new compartmentalized cookware system which is not anticipated, rendered obvious, suggested, or even implied by any of the prior art compartmentalized cookware systems, either alone or in any combination thereof.

It is another object of the present invention to provide a new compartmentalized cookware system which may be easily and efficiently manufactured and marketed.

It is a further object of the present invention to provide a new compartmentalized cookware system which is of a durable and reliable construction.

An even further object of the present invention is to provide a new compartmentalized cookware system which is susceptible of a low cost of manufacture with regard to both materials and labor, and which accordingly is then susceptible of low prices of sale to the consuming public, thereby making such compartmentalized cookware system economically available to the buying public.

Still yet another object of the present invention is to provide a new compartmentalized cookware system which provides in the apparatuses and methods of the prior art some of the advantages thereof, while simultaneously overcoming some of the disadvantages normally associated therewith.

Still another object of the present invention is to provide a new compartmentalized cookware system for cooking a plurality of different food items in a single container.

Yet another object of the present invention is to provide a new compartmentalized cookware system which includes at least one cooking containers having a bottom wall, a perimeter side wall upwardly extending around the bottom wall, and an upper edge defining an open top into the respective cooking container. The cooking container has at least one dividing wall therein upwardly extending from the bottom wall of the respective cooking container and dividing the cooking container into a plurality of cooking compartments.

Still yet another object of the present invention is to provide a new compartmentalized cookware system that lets a user cook several food dishes in a single cooking container and over a single heating source thereby reducing the need for several heating sources to cook all of the dishes at one time.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
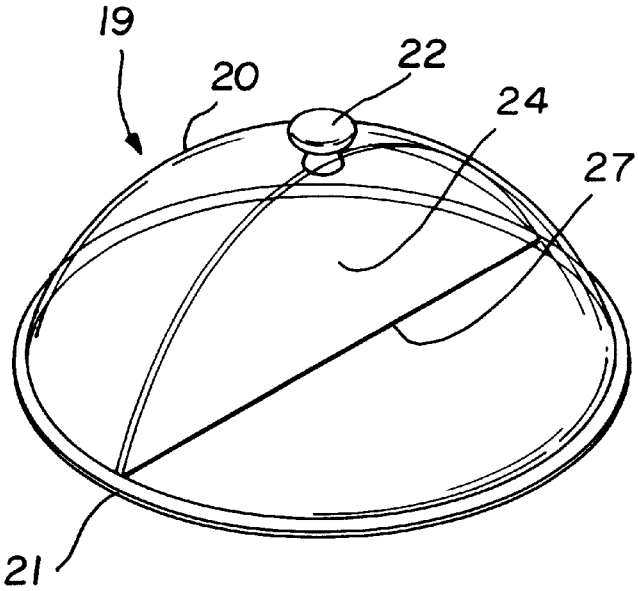
FIG. 1 is a schematic perspective view of an embodiment of a lid of a new compartmentalized cookware system according to the present invention.

With reference now to the drawings, and in particular to FIGS. 1 through 5 thereof, a new compartmentalized cookware system embodying the principles and concepts of the present invention will be described.

As best illustrated in FIGS. 1 through 5, the compartmentalized cookware system generally comprises at least one cooking containers having a bottom wall, a perimeter side wall upwardly extending around the bottom wall, and an upper edge defining an open top into the respective cooking container. The cooking container has at least one dividing wall therein upwardly extending from the bottom wall of the respective cooking container and dividing the cooking container into a plurality of cooking compartments.

In closer detail, the cookware system comprises a plurality of cooking containers 10*a*,10*b*,10*c*,10*d* each having a bottom wall 11, a perimeter side wall 12 upwardly extending around the bottom wall, and an upper edge 13 defining an open top into the respective cooking container.

In one embodiment, each cooking container may have a handle 14 coupled to the perimeter side wall of the respective cooking container adjacent the upper edge of the respective cooking container. Optionally, in such an embodiment, the handle of each cooking container may have a hanging hole 15 adjacent a free outer end of the respective handle for permitting hanging of the handles therewith.

Each of the cooking containers has at least one substantially planar dividing wall 16 therein upwardly extending from the bottom wall of the respective cooking container and coupled to the perimeter side wall of the respective cooking container to divide the respective cooking container into a plurality of cooking compartments 17 each designed for holding food (solid and liquid) therein separate from the food in the other cooking compartments.

Figure 2:
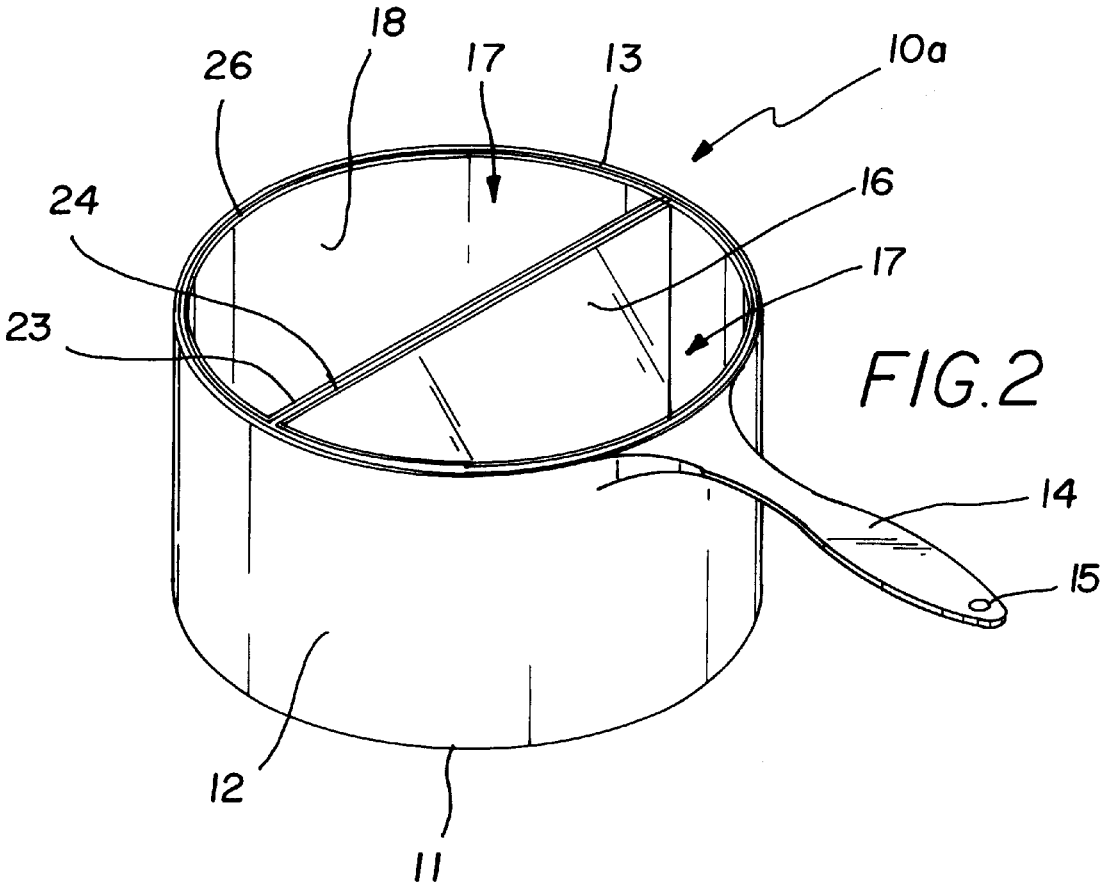
FIG. 2 is a schematic perspective view of a first embodiment of a cooking container of the present invention.

With reference to FIG. 2, a first of the cooking containers 10*a* has one dividing wall extending across a diameter of the first cooking container to divide the first cooking container into a pair of generally semi-circular cooking compartments.

Figure 4:
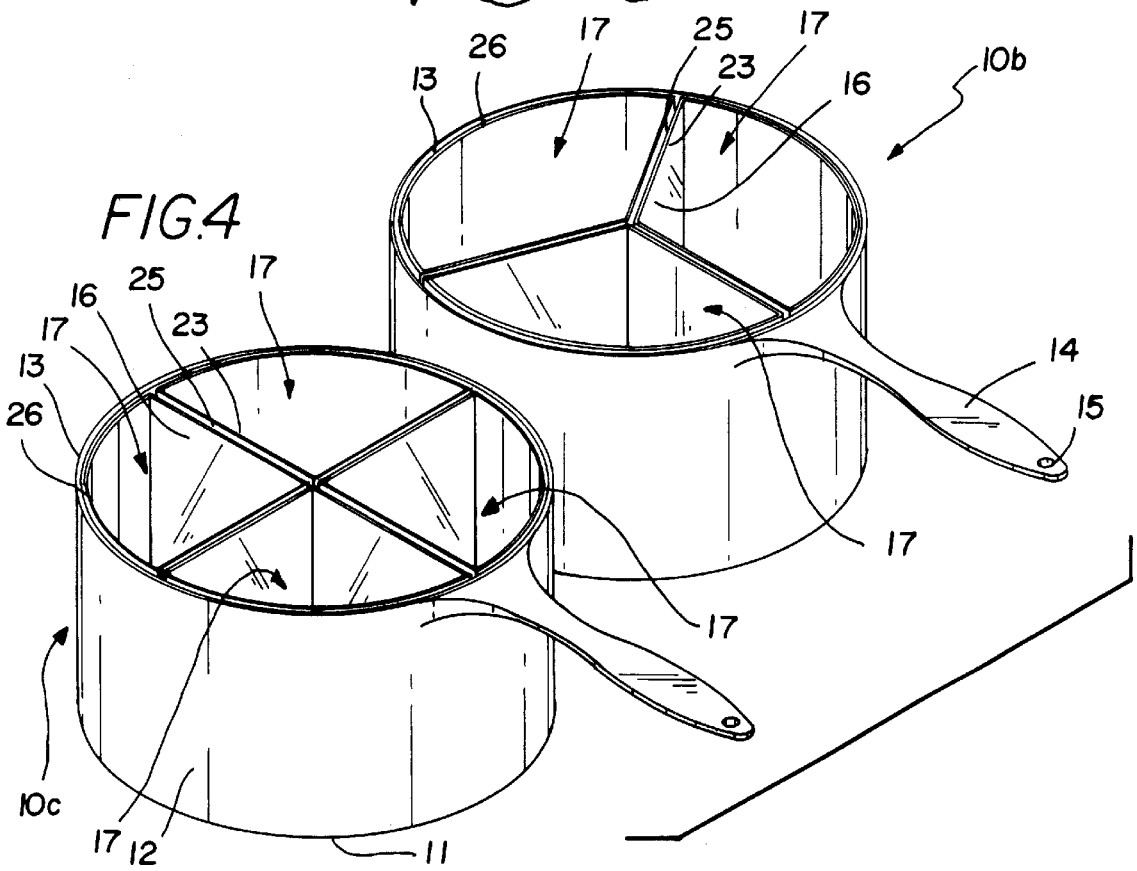
FIG. 4 is a schematic perspective view of second and third embodiments of a cooking container of the present invention.

With reference to FIG. 4, a second of the cooking containers 10*b* has three interconnected dividing wall outwardly radiating from a center axis of the second cooking container to the perimeter side wall of the second cooking container to divide the second cooking container into three generally triangular-wedge-shaped cooking compartments. In one embodiment of the second cooking container, the dividing walls of the second cooking container may be spaced apart at substantially equal intervals such that the cooking compartments of the second cooking container have substantially equal volumes to one another.

Also illustrated in FIG. 4, is a third of the cooking containers 10*c* having four interconnected dividing wall outwardly radiating from a center axis of the third cooking container to the perimeter side wall of the third cooking container to divide the third cooking container into four generally triangular-wedge-shaped cooking compartments. The third cooking container may be spaced apart at substantially equal intervals such that the cooking compartments of the third cooking container have substantially equal volumes to one another.

Figure 5:
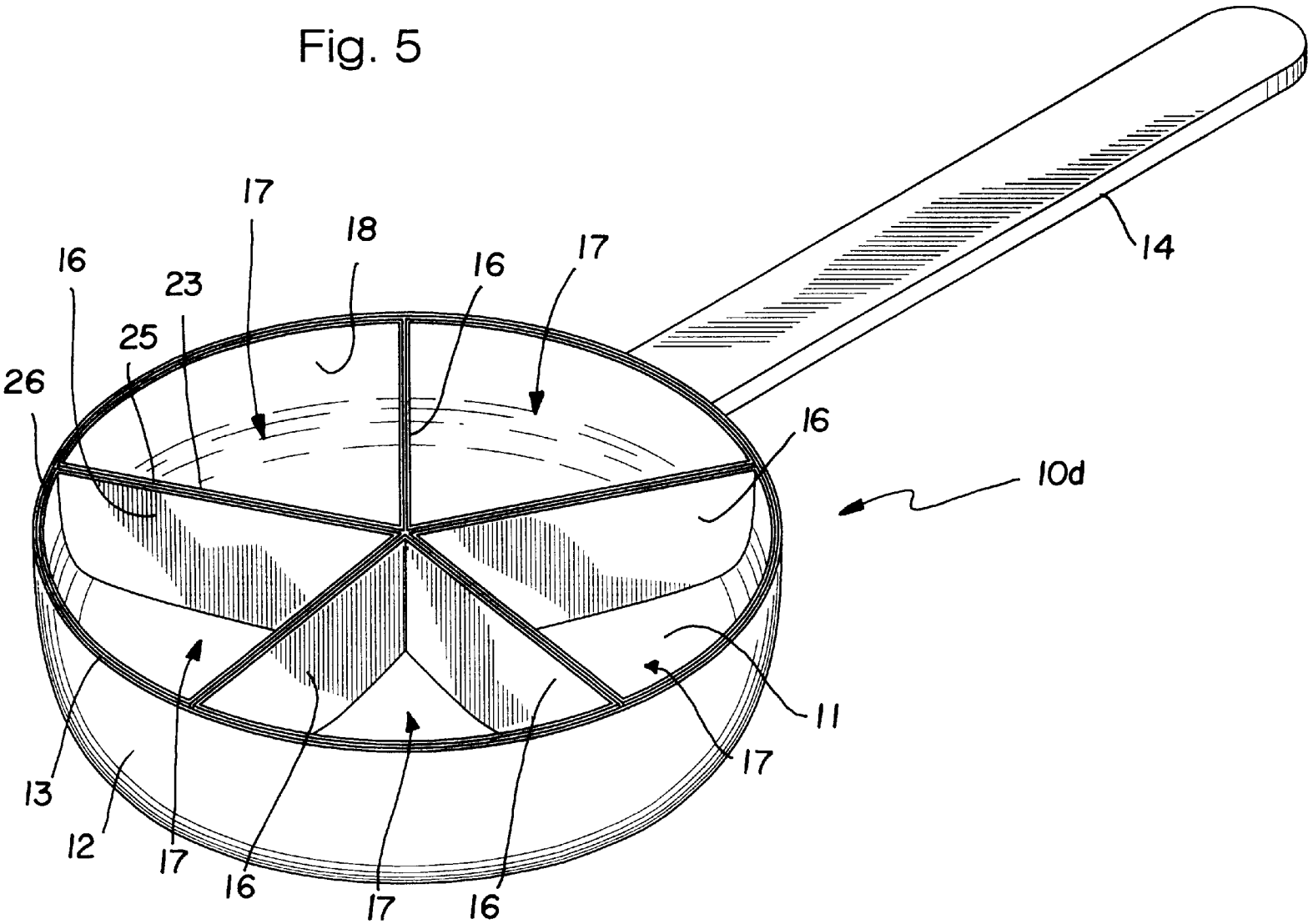
FIG. 5 is a schematic perspective view of a fourth embodiment of a cooking container of the present invention.

A fourth of the cooking containers 10*d* is illustrated in FIG. 5. The fourth cooking container has five interconnected dividing wall outwardly radiating from a center axis of the fourth cooking container to the perimeter side wall of the fourth cooking container to divide the fourth cooking container into five generally triangular-wedge-shaped cooking compartments. The dividing walls of the fourth cooking container may be spaced apart at substantially equal intervals such that the cooking compartments of the fourth cooking container have substantially equal volumes to one another.

The bottom and perimeter side walls of the cooking containers each has an inner face 18. In one embodiment of the cookware system, the inner faces of the bottom and perimeter side walls and the dividing walls of the cooking container each have substantially coextensive non-stick coating provided thereon for helping to prevent food from sticking thereto. The non-stick coating may comprises a polytetrafluoroethylene coating such as the coating sold under the tradename TEFLON.

With reference FIG. 1 each of the cooking containers has an associated lid 19 resting on the upper edge of the respective cooking container to substantially cover the open top of the respective cooking container in one embodiment of the cookware system. Each of the lids has a generally dome-shaped configuration comprising a concave lower face and a convex upper face 20, and an outer peripheral edge 21.

In one embodiment, each of the lids may include a lid handle 22 coupled to the outer face of the respective lid optionally at a center point on the outer face of the respective lid.

In an embodiment of the system, the lids each may comprise a translucent material. In another embodiment, the lids each may comprise a transparent material.

The dividing walls each has a top edge 23. In one preferred embodiment, the top edge of each dividing wall may lie in a common plane with the upper edge of the respective cooking container.

Each of the lids preferably has at least one substantially planar partition 24 downwardly depending from the lower face of the respective lid. Each of the partitions of each of the lids is associated with a corresponding dividing wall of the corresponding cooking container.

For example, a first of the lids has one partition extending across a diameter of the outer peripheral edge of the first lid to divide the first lid into a pair of generally semi-circular portions to permit resting on the first cooking container.

A second of the lids has three interconnected partition outwardly radiating from a center axis of the second lid to the outer peripheral edge of the second lid to divide the second lid into three generally triangular-wedge-shaped portions to rest on the second cooking container. Additionally, the partitions of the second lid may be spaced apart at substantially equal intervals to be aligned with the dividing walls of the second cooking container.

A third of the lids may have four interconnected partition outwardly radiating from a center axis of the third lid to the outer peripheral edge of the third lid to divide the third lid into four generally triangular-wedge-shaped portions for resting on the third cooking container. Preferably, the partitions of the third lid are spaced apart at substantially equal intervals to be aligned with the dividing walls of the third cooking container.

A fourth of the lids may have five interconnected partition outwardly radiating from a center axis of the fourth lid to the outer peripheral edge of the fourth lid to divide the fourth lid into five generally triangular-wedge-shaped portions to correspond to the fourth cooking container. In such an embodiment, the partitions of the fourth lid may be spaced apart at substantially equal intervals to be aligned with the dividing walls of the fourth cooking container.

The top edges of the dividing walls each may have an elongate divider channel 25 extending therealong the length of the respective dividing wall. In such an embodiment, the upper edge of each cooking container has a container channel 26 extending therearound. Preferably, the container channel of each cooking container is in communication with the dividers channel of each of the dividing walls of the respective cooking container.

Each of the partitions of each of the cooking containers has a lower edge 27. The lower edges of the partitions each has a downwardly extending elongate partition groove 28 therealong.

Similar to the upper edge of the cooking containers, the outer peripheral edge of each lid has a lid groove extending therearound and is preferably connected to each of the partitions grooves of the respective lid.

Figure 3:
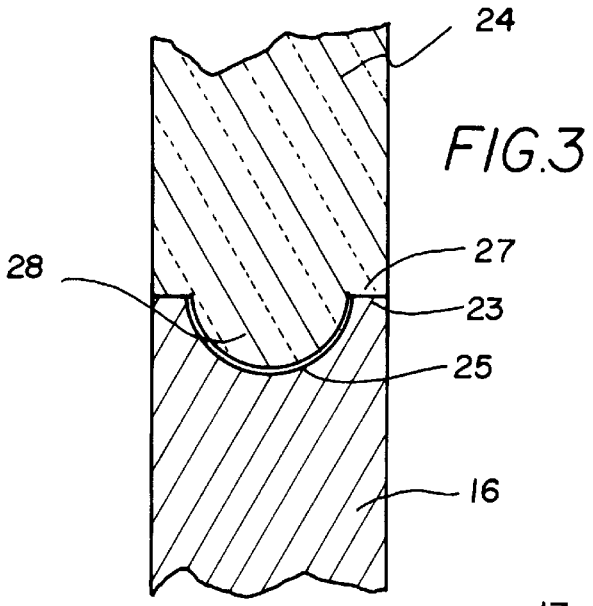
FIG. 3 is a schematic cross sectional view of the interlocking grooves and channels of the lids and cooking containers of the cookware system.

As best illustrated in FIG. 3, each partition groove of each lid is inserted into the associated corresponding divider channel of the corresponding cooking container. Similarly, the lid groove of each lid is inserted into the container channel of the associated corresponding cooking container. This allows the grooves and channels to form moisture barrier seals between each of the cooking compartments to keep each cooking compartment separated when cooking with the lid on the cooking container.

As illustrated in FIG. 3, in a preferred embodiment, the grooves each have a generally semi-circular convex transverse cross section and the channels each have a generally semi-circular concave transverse cross section corresponding to the shape of the grooves to receive the grooves therein.

In one possible embodiment, each of the cooking container is generally cylindrical such that the bottom walls of the cooking container are each generally circular and the perimeter side walls of the cooking container are each generally cylindrical. In such an embodiment, the outer peripheral edge of each lid is generally circular in shape.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cookware system, comprising:

at least one cooking container having a bottom wall, a perimeter side wall upwardly extending around said bottom wall, and an upper edge defining an open top into the respective cooking container;

said cooking container having at least one dividing wall therein upwardly extending from said bottom wall of the respective cooking container and dividing said cooking container into a plurality of cooking compartments; and an associated lid resting on said upper edge of the cooking container to substantially cover said open top of the cooking container; and said lid having a lower face, and at least one partition downwardly depending from said lower face of the lid, said dividing wall having a top edge, said top edge of said dividing wall having an elongate divider channel extending therealong, wherein said partition of said cooking container has a lower edge, said lower edge of said partition having a downwardly extending elongate partition therealong, said partition being inserted into the divider channel of the corresponding cooking container, said partitions and channels forming moisture barriers between each of the cooking compartments to keep each cooking compartment separated when cooking with the lid on the cooking container, said channels in said divider walls forming a outward flow path for moisture to the perimeter side wall for permitting escape of said moisture from said cooking compartments.

2. The cookware system of claim 1, wherein said cooking container has a handle coupled to said perimeter side wall of the cooking container adjacent said upper edge of the cooking container.

3. The cookware system of claim 2, wherein said handle of said cooking container has a hanging hole adjacent a free outer end of said handle.

4. The cookware system of claim 1, wherein said cooking container is generally cylindrical such that said bottom wall of said cooking container is generally circular and said perimeter side walls of said cooking container is generally cylindrical.

5. The cookware system of claim 1, wherein said cooking container has one dividing wall extending across a diameter of said cooking container to divide said cooking container into a pair of cooking compartments.

6. The cookware system of claim 1, wherein said cooking container has three interconnected dividing wall outwardly radiating from a center axis of said cooking container to said perimeter side wall of said cooking container to divide said cooking container into three generally triangular-wedge-shaped cooking compartments.

7. The cookware system of claim 6, wherein said dividing walls of said cooking container are spaced apart at substantially equal intervals such that said cooking compartments of said cooking container have substantially equal volumes.

8. The cookware system of claim 1, wherein said cooking container has four interconnected dividing wall outwardly radiating from a center axis of said cooking container to said perimeter side wall of said cooking container to divide said cooking container into four generally triangular-wedge-shaped cooking compartments.

9. The cookware system of claim 8, wherein said dividing walls of said cooking container are spaced apart at substantially equal intervals such that said cooking compartments of said cooking container have substantially equal volumes.

10. The cookware system of claim 1, wherein said cooking container has five interconnected dividing wall outwardly radiating from a center axis of said cooking container to said perimeter side wall of said cooking container to divide said cooking container into five generally triangular-wedge-shaped cooking compartments.

11. The cookware system of claim 10, wherein said dividing walls of said cooking container are spaced apart at substantially equal intervals such that said cooking compartments of said cooking container have substantially equal volumes.

12. The cookware system of claim 1, wherein said bottom and perimeter side walls of said cooking container each having an inner face, wherein said inner faces of said bottom and perimeter side walls and said dividing walls of said cooking container each have substantially coextensive non-stick coating provided thereon.

13. A cookware system, comprising:

a plurality of cooking containers each having a bottom wall, a perimeter side wall upwardly extending around said bottom wall, and an upper edge defining an open top into the respective cooking container;

each cooking container having a handle coupled to said perimeter side wall of the respective cooking container adjacent said upper edge of the respective cooking container;

said handle of each cooking container having a hanging hole adjacent a free outer end of the respective handle;

wherein each of said cooking container is generally cylindrical such that said bottom walls of said cooking container are each generally circular and said perimeter side walls of said cooking container are each generally cylindrical;

each of said cooking containers having at least one substantially planar dividing wall therein upwardly extending from said bottom wall of the respective cooking container and dividing the respective cooking container into a plurality of cooking compartments;

a first of said cooking containers having one dividing wall extending across a diameter of said first cooking container to divide said first cooking container into a pair of generally semi-circular cooking compartments;

a second of said cooking containers having three interconnected dividing wall outwardly radiating from a center axis of said second cooking container to said perimeter side wall of said second cooking container to divide said second cooking container into three generally triangular-wedge-shaped cooking compartments;

wherein said dividing walls of said second cooking container are spaced apart at substantially equal intervals such that said cooking compartments of said second cooking container have substantially equal volumes;

a third of said cooking containers having four interconnected dividing wall outwardly radiating from a center axis of said third cooking container to said perimeter side wall of said third cooking container to divide said third cooking container into four generally triangular-wedge-shaped cooking compartments;

wherein said dividing walls of said third cooking container are spaced apart at substantially equal intervals such that said cooking compartments of said third cooking container have substantially equal volumes;

a fourth of said cooking containers having five interconnected dividing wall outwardly radiating from a center axis of said fourth cooking container to said perimeter side wall of said fourth cooking container to divide said fourth cooking container into five generally triangular-wedge-shaped cooking compartments;

wherein said dividing walls of said fourth cooking container are spaced apart at substantially equal intervals such that said cooking compartments of said fourth cooking container have substantially equal volumes;

wherein said bottom and perimeter side walls of said cooking containers each having an inner face;

wherein said inner faces of said bottom and perimeter side walls and said dividing walls of said cooking container each have substantially coextensive non-stick coating provided thereon;

each of said cooking containers having an associated lid resting on said upper edge of the respective cooking container to substantially cover said open top of the respective cooking container;

each of said lids having a generally dome-shaped configuration comprising a concave lower face and a convex upper face, and an outer peripheral edge;

said outer peripheral edge of each lid being generally circular in shape;

each of said lids having a lid handle coupled to said outer face of the respective lid at a center point on said outer face of the respective lid;

wherein said lids each comprise a translucent material;

said dividing walls each having a top edge, said top edge of each dividing wall lying in a common plane with said upper edge of the respective cooking container;

said top edges of said dividing walls each having an elongate divider channel extending therealong;

said upper edge of each cooking container having a container channel extending therearound, said container channel of each cooking container being in communication with said dividers channel of each of said dividing walls of the respective cooking container;

said partitions and channels forming moisture barriers between each of the cooking compartments to keep each cooking compartment separated when cooking with the lid on the cooking container;

each of said lids having at least one substantially planar partition downwardly depending from said lower face of the respective lid;

each of said partitions of each of said lids being associated with a corresponding dividing wall of the corresponding cooking container;

a first of said lids having one partition extending across a diameter of said outer peripheral edge of said first lid to divide said first lid into a pair of generally semi-circular portions;

a second of said lids having three interconnected partition outwardly radiating from a center axis of said second lid to said outer peripheral edge of said second lid to divide said second lid into three generally triangular-wedge-shaped portions;

wherein said partitions of said second lid are spaced apart at substantially equal intervals to be aligned with the dividing walls of the second cooking container;

a third of said lids having four interconnected partition outwardly radiating from a center axis of said third lid to said outer peripheral edge of said third lid to divide said third lid into four generally triangular-wedge-shaped portions;

wherein said partitions of said third lid are spaced apart at substantially equal intervals to be aligned with the dividing walls of the third cooking container;

a fourth of said lids having five interconnected partition outwardly radiating from a center axis of said fourth lid to said outer peripheral edge of said fourth lid to divide said fourth lid into five generally triangular-wedge-shaped portions;

wherein said partitions of said fourth lid are spaced apart at substantially equal intervals to be aligned with the dividing walls of the fourth cooking container;

each of said partitions of each of said cooking containers having a lower edge, said lower edges of said partitions each having a downwardly extending elongate partition groove therealong;

said outer peripheral edge of each lid having a lid groove extending therearound, said lid groove of each lid being connected to each of said partitions grooves of the respective lid;

each partition groove of each lid being inserted into the associated corresponding divider channel of the corresponding cooking container;

said lid groove of each lid being inserted into the container channel of the associated corresponding cooking container;

said grooves each having a generally semi-circular convex transverse cross section; and said channels each having a generally semi-circular concave transverse cross section.

14. The cookware system of claim 1, wherein a first of said associated lids has one partition extending across a diameter of said outer peripheral edge of said first lid to divide said first lid into a pair of generally semi-circular portions.

15. The cookware system of claim 1, wherein a second of said associated lids has three interconnected partitions outwardly radiating from a center axis of said second lid to said outer peripheral edge of said second lid to divide said second lid into three generally triangular-wedge-shaped portions.

16. The cookware system of claim 15, wherein wherein said partitions of said second associated lid are spaced apart at substantially equal intervals to be aligned with the dividing walls of the second cooking container.

17. The cookware system of claim 1, wherein a third of said associated lids has four interconnected partitions outwardly radiating from a center axis of said third lid to said outer peripheral edge of said third lid to divide said third lid into four generally triangular-wedge-shaped portions.

18. The cookware system of claim 17, wherein wherein said partitions of said third lid are spaced apart at substantially equal intervals to be aligned with the dividing walls of the third cooking container.

19. The cookware system of claim 1, wherein a fourth of said associated lids has five interconnected partition outwardly radiating from a center axis of said fourth lid to said outer peripheral edge of said fourth lid to divide said fourth lid into five generally triangular-wedge-shaped portions.

20. The cookware system of claim 19, wherein said partitions of said fourth lid are spaced apart at substantially equal intervals to be aligned with the dividing walls of the fourth cooking container.

* * * * *